US008348593B2

(12) United States Patent
Yoshida

(10) Patent No.: US 8,348,593 B2
(45) Date of Patent: Jan. 8, 2013

(54) SERIAL AXIAL FAN

(75) Inventor: Yusuke Yoshida, Kyoto (JP)

(73) Assignee: Nidec Corporation, Kyoto (JP)

( * ) Notice: Subject to any disclaimer, the term of this patent is extended or adjusted under 35 U.S.C. 154(b) by 631 days.

(21) Appl. No.: 12/550,676

(22) Filed: Aug. 31, 2009

(65) Prior Publication Data

US 2010/0054931 A1 Mar. 4, 2010

(30) Foreign Application Priority Data

Sep. 2, 2008 (JP) ..... 2008-224265
Oct. 20, 2008 (JP) ..... 2008-269522

(51) Int. Cl.
*F04D 29/52* (2006.01)

(52) U.S. Cl. .... 415/66; 416/128; 416/198 R; 416/223 R

(58) Field of Classification Search ..... 415/66, 415/191, 211.2; 416/128, 223 R, 198 R, 416/228, 241 R
See application file for complete search history.

(56) References Cited

U.S. PATENT DOCUMENTS 7,445,423 B2 * 11/2008 Ishihara et al. ..... 415/61
7,740,446 B2 * 6/2010 Lin et al. ..... 415/199.4
2007/0059155 A1 3/2007 Ishihara et al.

FOREIGN PATENT DOCUMENTS

JP 03-156193 A 7/1991
JP 10-288199 A 10/1998
JP 3438356 B2 8/2003
JP 2004-251179 A 9/2004
JP 2006-322379 A 11/2006
JP 2007-303432 A 11/2007
JP 2008-095701 A 4/2008
JP 4128194 B2 7/2008

OTHER PUBLICATIONS

BASF Corporation, Basic Guidelines for Plastic Conversion of Metal Axial Flow Fans, 2003 BASF Corporation.*
Official Communication issued in corresponding International Application PCT/JP2009/065330, issued on Mar. 8, 2011.

* cited by examiner

*Primary Examiner* — Edward Look
*Assistant Examiner* — Liam McDowell
(74) *Attorney, Agent, or Firm* — Keating & Bennett, LLP

(57) ABSTRACT

A serial axial fan includes first and second axial fans. The first axial fan preferably includes a first motor portion, a first impeller, and a first housing. The second axial fan preferably includes a second motor portion, a second impeller, and a second housing. In the first impeller, an angle defined by a rotational plane of the first impeller with a chord of each blade of the first impeller on an imaginary cylindrical surface centered about a central axis increases as the radius of the imaginary cylindrical surface increases.

11 Claims, 12 Drawing Sheets

SERIAL AXIAL FAN

BACKGROUND OF THE INVENTION

1. Field of the Invention

The present invention relates to a serial axial fan.

2. Description of the Related Art

Electronic devices, such as personal computers (PCs) or servers, are commonly provided with a cooling fan for ventilation inside a case thereof and to cool electronic components contained therein. In particular, for use in comparatively large electronic devices such as servers, cooling fans that produce an air flow with high static pressure have been desired. One type of such cooling fans in current use are serial axial fans composed of two axial fans connected in series along a central axis such that impellers of the two axial fans rotate in opposite directions.

For example, in a serial axial fan described in JP-A-2008-95701, a vertical section of each blade of each impeller forms smaller angles with a rotational plane of the impeller at radially outward positions than at radially inward positions.

JP-A-2007-303432 discloses a counter-rotating blower in which a solidity ratio of a downstream axial fan in relation to an upstream axial fan is set in a range of 0.6 to 0.9. It is suggested that, according to this counter-rotating blower, setting a workload ratio of the downstream axial fan in relation to the upstream axial fan in a range of 0.6 to 0.9 will additionally reduce a decrease in air blowing efficiency.

Japanese Patent No. 4128194 discloses a counter-rotating axial blower in which an axial dimension of a first case provided in an inlet-side fan is larger than an axial dimension of a second case provided in an outlet-side fan.

JP-A 03-156193 discloses a counter-rotating ventilator in which a distance between a first impeller and a second impeller is set to 1.2 to 1.7 times an outer diameter of the impellers to achieve noise reduction.

The proportion of a workload of the impeller to a given power consumption is greatest at a radially outer portion of the impeller of axial fans. In the axial fan described in JP-A 2008-95701, the angle formed by each blade with the rotational plane of the impeller is arranged to be smaller at the radially outer portion thereof than at a radially inner portion thereof in order to increase air suction efficiency. This makes it difficult to generate most of work by the radially outer portion of the impeller.

A counter-rotating serial axial fan produces more noise than individual fans because of interference of blades of an inlet-side impeller and blades of an outlet-side impeller with each other. Accordingly, additional noise reduction is desired in accordance with an improvement in a "static pressure-air flow volume characteristic" of the serial axial fan.

SUMMARY OF THE INVENTION

Preferred embodiments of the present invention provide an improvement in the static pressure-air flow volume characteristic of serial axial fans and also to reduce an increase in noise.

According to a preferred embodiment of the present invention, a serial axial fan including a first axial fan and a second axial fan connected to the first axial fan along a central axis of the first axial fan is provided. The first axial fan preferably includes a first motor portion; a first impeller having a plurality of first blades extending radially outward to be centered about the central axis and arranged at regular intervals in a circumferential direction, and arranged to rotate about the central axis due to action of the first motor portion to produce an air flow along the central axis and toward the second axial fan; and a first housing surrounding an outer circumference of the first impeller. The second axial fan preferably includes a second motor portion; a second impeller having a plurality of second blades extending radially outward to be centered about the central axis and arranged at regular intervals in the circumferential direction, and arranged to rotate about the central axis due to the action of the second motor portion in an opposite direction to that in which the first impeller rotates, to produce an air flow in the same direction as that of the air flow produced by the first impeller; and a second housing surrounding an outer circumference of the second impeller. In the first impeller, an angle formed by a rotational plane of the first impeller with a chord of each first blade on an imaginary cylindrical surface centered about the central axis increases as a radius of the imaginary cylindrical surface increases.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

In the following description, an upper side with respect to a direction parallel or substantially parallel to a central axis J1 will be referred to simply as an "upper side", "above", etc., whereas a lower side with respect to the direction parallel or substantially parallel to the central axis J1 will be referred to simply as a "lower side", "below", etc. Note that terms referring to "upward", "downward", "left", "right", etc., as used in the description of the present invention to describe relative positions or directions of different members are simply used with reference to the accompanying drawings, and should not be construed as describing relative positions or directions of those members when actually installed in a device.

Figure 1:
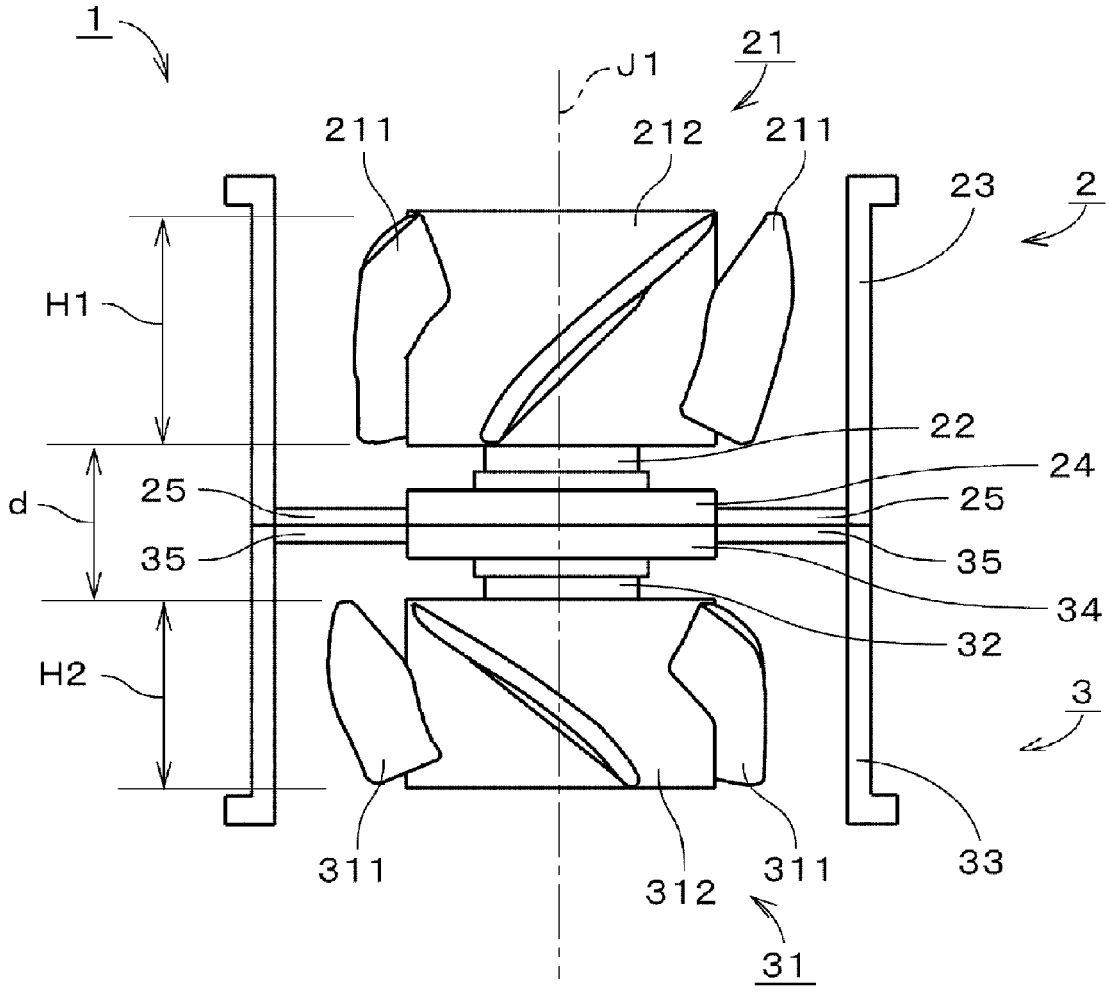
FIG. 1 is a cutaway view of a serial axial fan according to a preferred embodiment of the present invention.

FIG. 1 is a cutaway front view of a serial axial fan 1 according to a preferred embodiment of the present invention, in which a housing is shown in section. The serial axial fan 1 is a counter-rotating axial fan, and could be used, for example, as a cooling fan to air-cool an electronic device such as a server. The serial axial fan 1 includes a first axial fan 2 and a second axial fan 3. The first axial fan 2 is arranged on the upper side in FIG. 1. The second axial fan 3 is arranged below the first axial fan 2 along the central axis J1 of the first axial fan 2, and connected to the first axial fan 2. The central axis J1 is also a central axis of the second axial fan 3.

In the serial axial fan 1 as illustrated in FIG. 1, air is taken in from above the serial axial fan 1, i.e., from above the first axial fan 2, and sent downward to exit the serial axial fan 1 through the second axial fan 3, resulting in a flow of the air along the central axis J1. Note that the upper and lower sides in FIG. 1 may not necessarily correspond with upper and lower sides, respectively, with respect to the direction of gravity.

The first axial fan 2 preferably includes a first impeller 21, a first motor portion 22, a first housing 23, a first base portion 24, and a plurality of first support ribs 25. The first motor portion 22 causes the first impeller 21 to rotate about the central axis J1. The first housing 23, shown in section, surrounds an outer circumference of the first impeller 21. The first base portion 24 is arranged to be adjacent to the second axial fan 3 and to support the first motor portion 22. The first support ribs 25 join the first base portion 24 to the first housing 23. In the present preferred embodiment, the number of first support ribs 25 is preferably four, but any desirable number of support ribs could be used. The first housing 23, the first base portion 24, and the first support ribs 25 are preferably produced by resin injection molding as a single integral member, but could be made from separate pieces or by any other suitable method.

The first impeller 21 is arranged to produce a flow of air toward the second axial fan 3 along the central axis J1. The first impeller 21 preferably includes a cup 212, which is substantially defined by the shape of a covered cylinder, and a plurality of first blades 211. The cup 212 covers a rotating portion of the first motor portion 22. In the present preferred embodiment, the number of first blades 21 is preferably five, but any desirable number of first blades 21 could be used. The cup 212 and the first blades 211 are preferably produced by resin injection molding as a single integral member, but could be made from separate pieces or by any other suitable method.

The structure of the second axial fan 3 is substantially similar to that of the first axial fan 2 but turned upside down. The second axial fan 3 preferably includes a second impeller 31, a second motor portion 32, a second housing 33, a second base portion 34, and a plurality of second support ribs 35. The second motor portion 32 causes the second impeller 31 to rotate about the central axis J1. The second housing 33 surrounds an outer circumference of the second impeller 31, and is connected to the first housing 23 along the central axis J1. The second base portion 34 is preferably substantially disc-shaped, and centered on the central axis J1, and supports the second motor portion 32. The second base portion 34 is in contact with the first base portion 24, which is also preferably substantially disc-shaped. The second support ribs 35 join the second base portion 34 to the second housing 33. In the present preferred embodiment, the number of second support ribs 35 is four, but any desirable number of support ribs could be used. The second housing 33, the second base portion 34, and the second support ribs 35 are produced by resin injection molding as a single integral member, but could be made from separate pieces or by any other suitable method.

The second impeller 31 includes a cup 312 and a plurality of second blades 311. The cup 312 covers a rotating portion of the second motor portion 32. In the present preferred embodiment, the number of second blades 311 is five, but any desirable number of second blades could be used. The cup 312 and the second blades 311 are produced by resin injection molding as a single integral member however, but could be made from separate pieces or by any other suitable method. The axial dimension, i.e., the dimension along the central axis J1, of the second impeller 31 is preferably smaller than that of the first impeller 21. In other words, the height H1, i.e., the dimension along the central axis J1, of the first blades 211 is greater than the height H2 of the second blades 311.

According to FIG. 1, the second blades 311 of the second impeller 31 and the first blades 211 of the first impeller 21 are preferably inclined in the direction substantially opposite from one and another with respect to the central axis. Also, the second axial fan 2 and the first axial fan 1 preferably rotate in directions opposite from one another. Therefore, an air flow generated by the fans will be guided in the same direction.

In the second axial fan 3, the second motor portion 32 causes the second impeller 31 to rotate about the central axis J1 in a direction opposite to the direction in which the first impeller 21 rotates. This results in a flow of air in the same direction as that of the air flow produced by the rotation of the first impeller 21 along the central axis J1, whereby the air is sent downward out of the serial axial fan 1.

Figure 2:
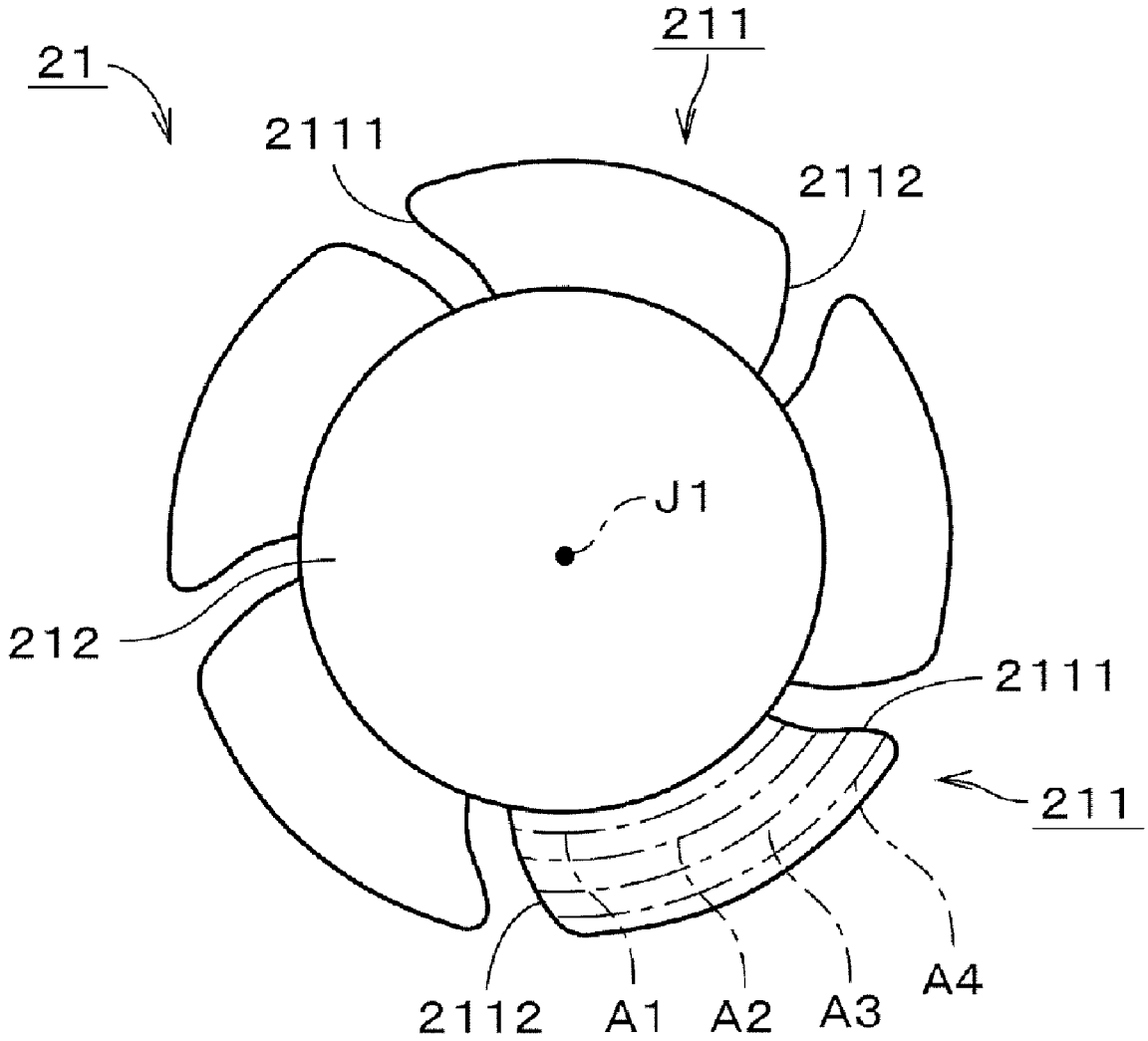
FIG. 2 is a plan view of a first impeller according to a preferred embodiment of the present invention.
Figure 3:
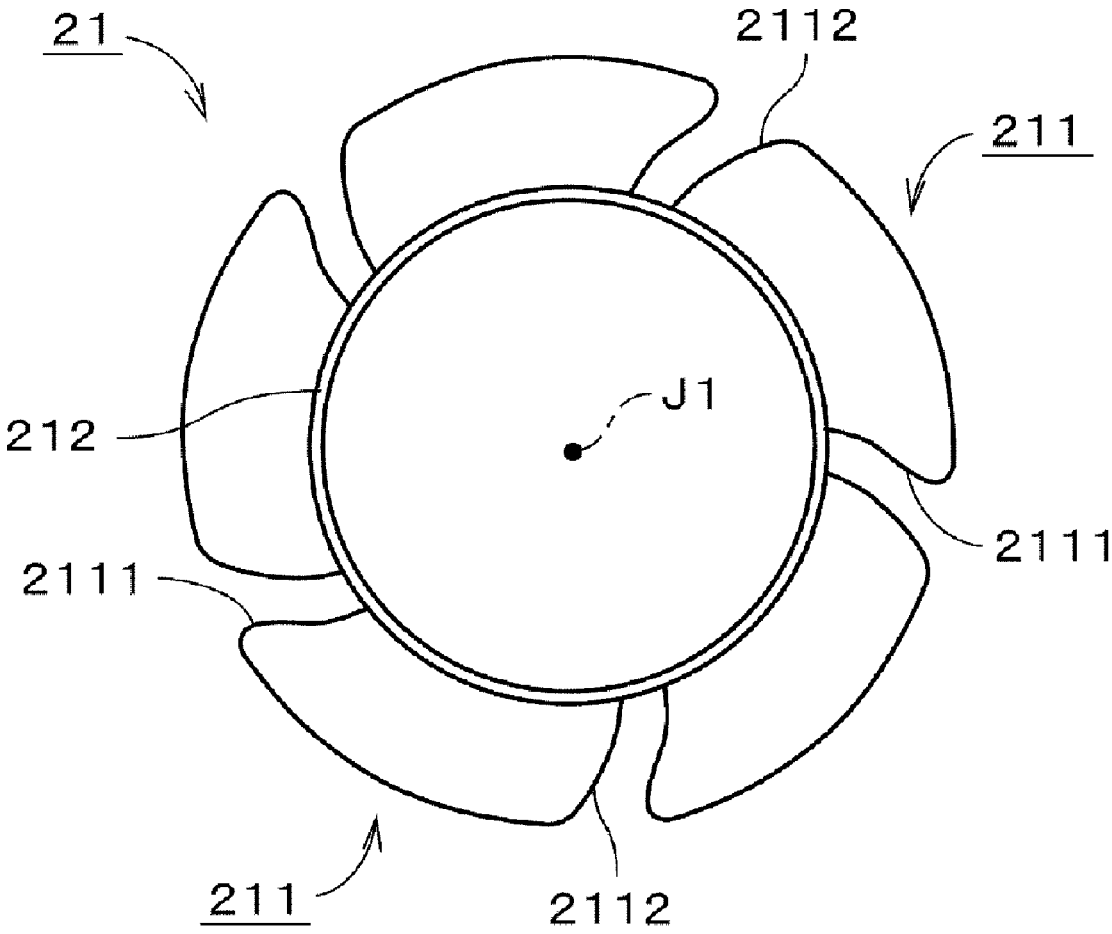
FIG. 3 is a bottom view of the first impeller.

FIG. 2 is a plan view of the first impeller 21. FIG. 3 is a bottom view of the first impeller 21. As illustrated in FIGS. 2 and 3, the five first blades 211 of the first impeller 21 extend radially outward from an outside surface of the cup 212 to be centered about the central axis J1, and are arranged at regular intervals in a circumferential direction. The first impeller 21 rotates counterclockwise in FIG. 2. In FIGS. 2 and 3, a leading edge and a trailing edge, with respect to the rotation direction, of each first blade 211 are designated by reference numerals 2111 and 2112, respectively.

Figure 4:
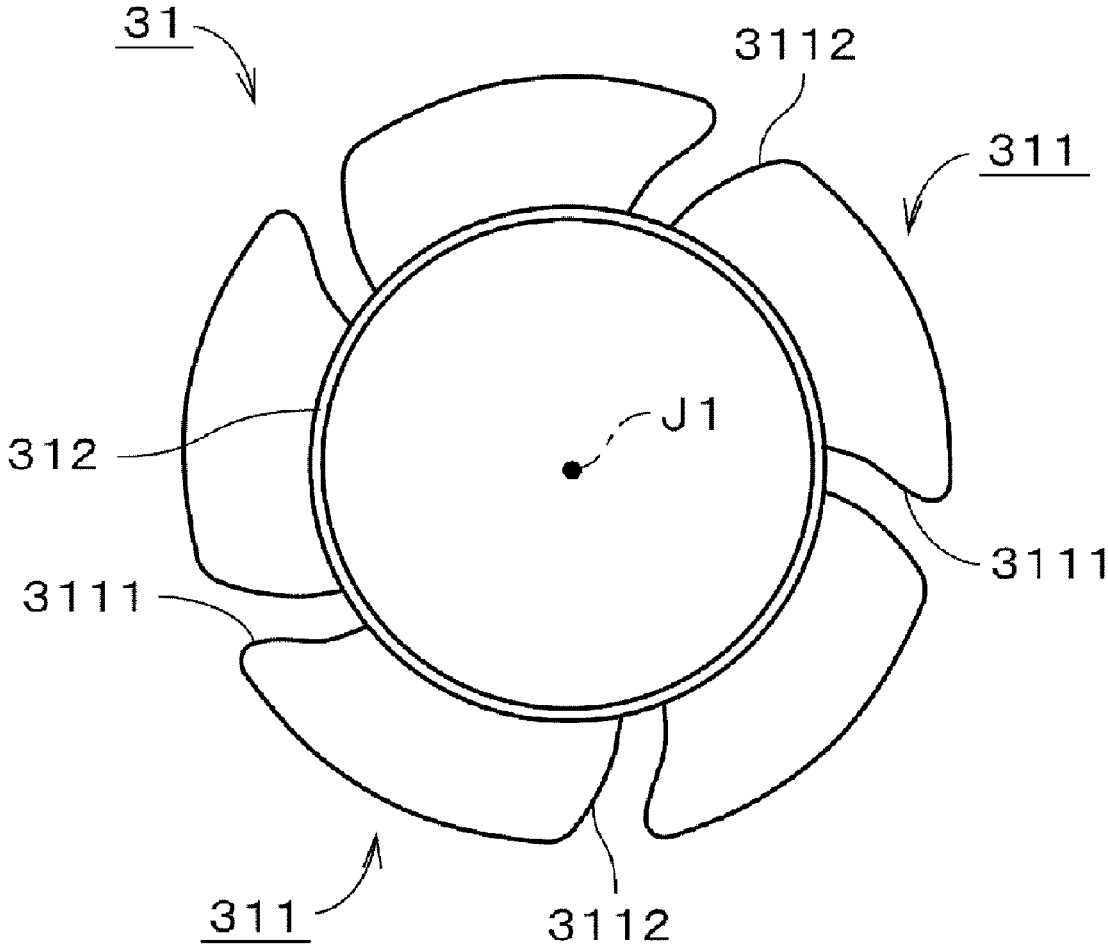
FIG. 4 is a plan view of a second impeller according to a preferred embodiment of the present invention.

FIG. 4 is a plan view of the second impeller 31. The five second blades 311 of the second impeller 31 extend radially outward from an outside surface of the cup 312 to be centered about the central axis J1, and are arranged at regular intervals in the circumferential direction. The second impeller 31 rotates clockwise in FIG. 4. In FIG. 4, a leading edge and a trailing edge, with respect to the rotation direction, of each second blade 311 are designated by reference numerals 3111 and 3112, respectively.

Figure 5:
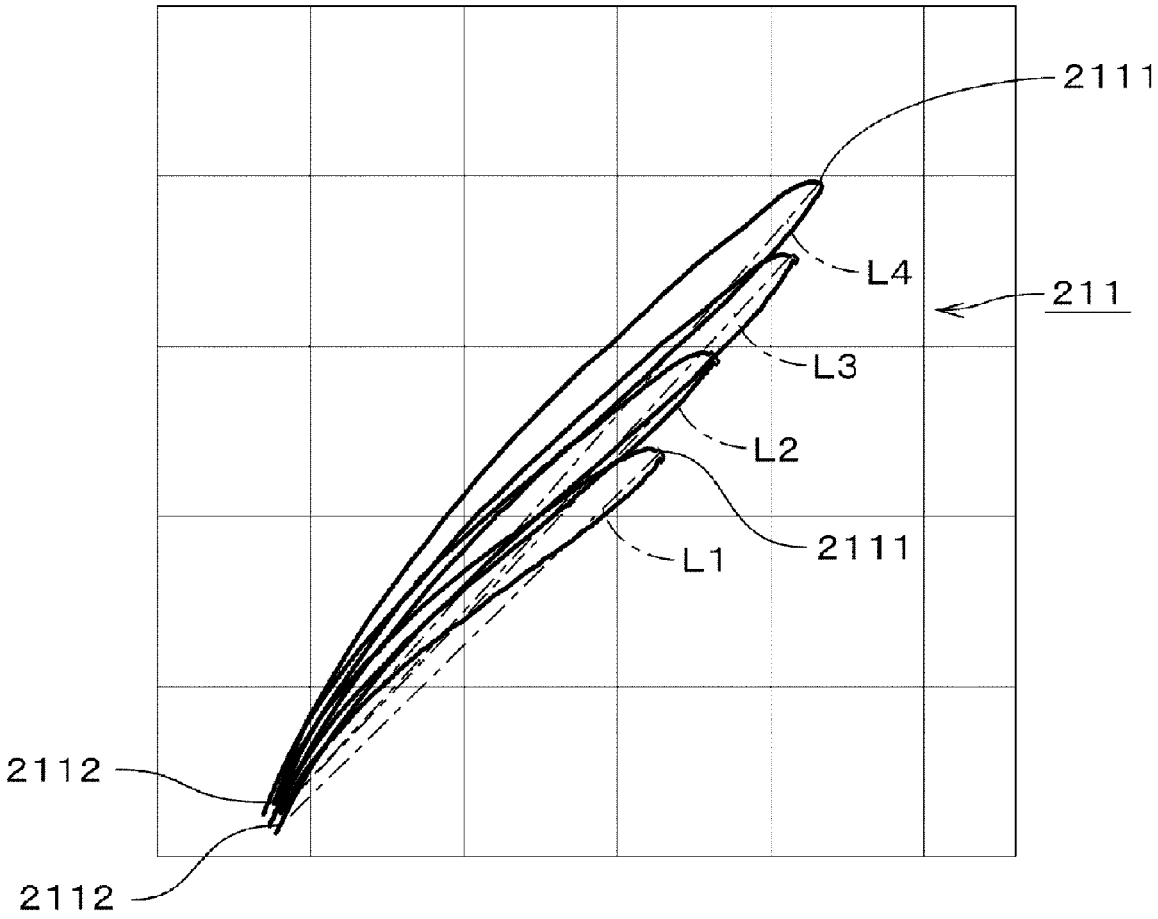
FIG. 5 illustrates sections of a first blade according to a preferred embodiment of the present invention.

FIG. 5 illustrates contours of sections of one of the first blades 211 taken on imaginary cylindrical surfaces centered about the central axis J1 indicated by reference symbols A1, A2, A3, and A4 in FIG. 2, where the contours are superimposed upon one another, and the imaginary cylindrical surfaces are developed on a plane. A vertical direction in FIG. 5 corresponds to the direction parallel or substantially parallel to the central axis J1. The right-hand side in FIG. 5 corresponds to the direction in which the first blade 211 moves when viewed radially from the outside. A dot-and-dash line represents a straight line joining the leading and trailing edges 2111 and 2112 of the first blade 211 in each section. In FIG. 5, reference symbols L1, L2, L3, and L4 denote the dot-and-dash lines for the sections corresponding to the positions of reference symbols A1, A2, A3, and A4, respectively.

The term "chord" as used herein in reference to the blades of the impellers is defined as follows. First, the section of the blade taken on the imaginary cylindrical surface centered about the central axis of the impeller is developed on a plane. Next, the leading and trailing edges of the blade are joined by a straight line in the section developed on the plane. This straight line is defined as a "chord". This definition of the term "chord" complies with common blade terminology.

As shown in FIG. 5, an angle defined by the chord with a rotational plane of the impeller, which is a plane perpendicular or substantially perpendicular to the central axis, is smallest in the case of the chord L1, and gradually increases until it becomes largest in the case of the chord L4. In other words, the angle defined by the chord of the first blade 211 with the rotational plane of the impeller progressively and gradually increases as the radial position of the chord moves outward, so that the first blade 211 is more erect at radially outward positions than at radially inward positions.

Meanwhile, the length of the chords L1 to L4 also increases as the radial position thereof moves outward. The dimension (i.e., height) of the first blade 211 in the direction parallel or substantially parallel to the central axis J1, across its width between the leading and trailing edges 2111 and 2112, also increases in a radially outward direction.

Moreover, as illustrated in FIGS. 2 and 3, the length of the chord of each first blade 211 increases significantly as the radial position of the chord moves outward, so that the circumferential width of the first blade 211, i.e., the circumferential distance between the leading and trailing edges 2111 and 2112 thereof, or the circumferential dimension of the first blade 211 as projected on a plane perpendicular or substantially perpendicular to the central axis J1, increases in the radially outward direction. This contributes to increasing the proportion of a workload of the first blades 211 to a given power consumption. The thickness of each first blade 211 is arranged to be greater at a radially inner portion thereof than at a radially outer portion thereof in order to maintain the strength thereof while increasing the length of the chord of the first blade 211 as the radial position of the chord moves outward.

Regarding the second blades 311 as illustrated in FIG. 4, as with the first blade 211 as illustrated in FIG. 5, in sections of each second blade 311 taken on imaginary cylindrical surfaces centered about the central axis J1, an angle defined by the chord joining the leading and trailing edges 3111 and 3112 with the rotational plane of the impeller increases as the radial position of the chord moves outward. In addition, the dimension of each second blade 311 in the direction parallel or substantially parallel to the central axis J1, across its width between the leading and trailing edges 3111 and 3112 thereof, increases in the radially outward direction. Further, the circumferential width of each second blade 311 between the leading and trailing edges 3111 and 3112 thereof also increases in the radially outward direction. Note that the thickness of each second blade 311 is also arranged to be greater at a radially inner portion thereof than at a radially outer portion thereof.

Axial fans having the above-described blade shape and used singly generally suffer an increase in a whirl component of exiting air resulting in a substantial amount of air being blown radially outward, and thus leading to a decrease in static pressure. In the serial axial fan 1, however, a whirl component of the air produced by the first axial fan 2 can be converted in the second axial fan 3 into an airflow traveling in an axial direction, as described below. This contributes to improving a "static pressure-air flow volume characteristic" while increasing a workload of the radially outer portion of the blades for a given power consumption.

Figure 6:
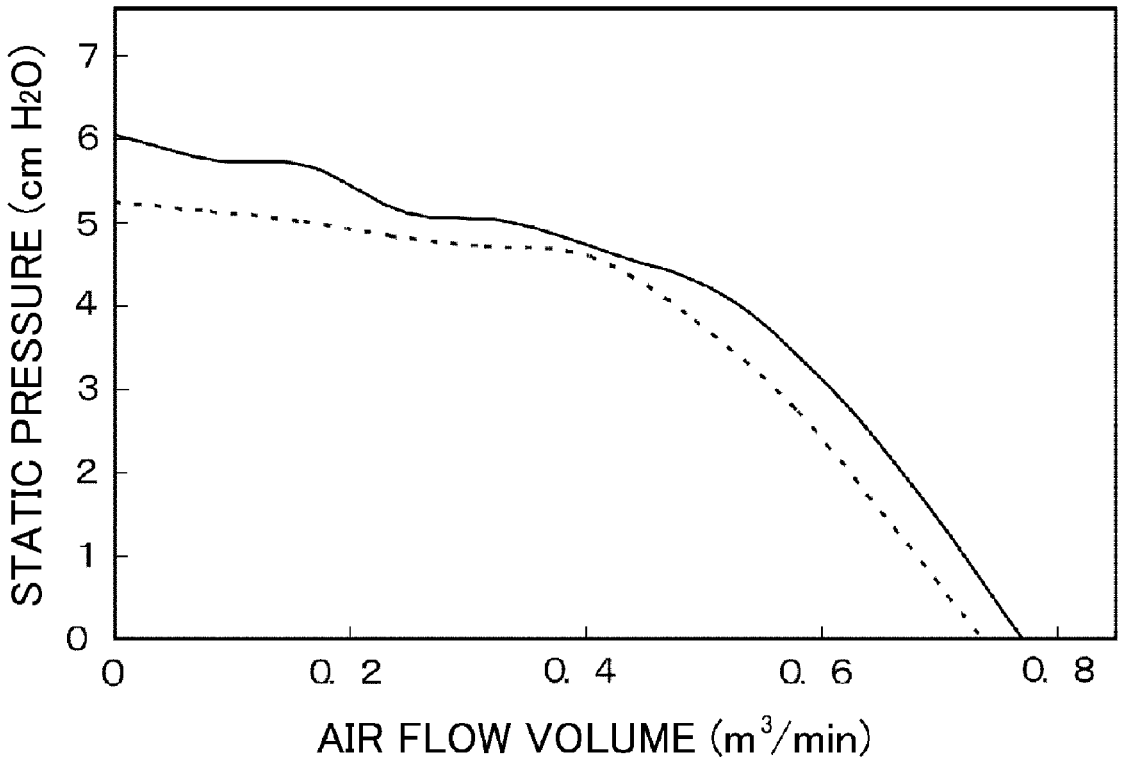
FIG. 6 illustrates a relationship between the shape of blades and a "static pressure-air flow volume characteristic".

FIG. 6 illustrates a relationship between the shape of blades of impellers in serial axial fans and the static pressure-air flow volume characteristic. A horizontal axis represents air flow volume ($m^3$/min), and a vertical axis represents the static pressure ($cmH_2O$, 1 $cmH_2O$=98.1 Pa).

The solid line in FIG. 6 indicates the static pressure-air flow volume characteristic of the serial axial fan 1. The first and second blades 211 and 311 used in the serial axial fan 1 are so shaped that the angle defined by the chord with the rotational plane of the corresponding impeller increases as the radial position of the chord moves outward.

The broken line in FIG. 6 indicates the static pressure-air flow volume characteristic of a serial axial fan as comparative example 1. The serial axial fan as comparative example 1 is similar to the serial axial fan 1 except in the shape of the first and second blades 211 and 311. Specifically, the first and second blades 211 and 311 used in comparative example 1 are so shaped that the angle defined by the chord with the rotational plane of the corresponding impeller decreases as the radial position of the chord moves outward. Note that measured values for the serial axial fan 1 and comparative example 1 as indicated in FIG. 6 have been obtained for the same power consumption.

The serial axial fan 1, in which the angle defined by the radially outer portion of each first blade 211 with the rotational plane of the corresponding impeller is large, accordingly suffers an increase in the whirl component of the air flow produced by the first blades 211. However, the second axial fan 3 in the serial axial fan 1 serves to convert the whirl component into the airflow traveling in the axial direction, thereby preventing a reduction in the static pressure. Because of this, as illustrated in FIG. 6, the serial axial fan 1 has an improved static pressure-air flow volume characteristic, when compared to comparative example 1.

Figure 7:
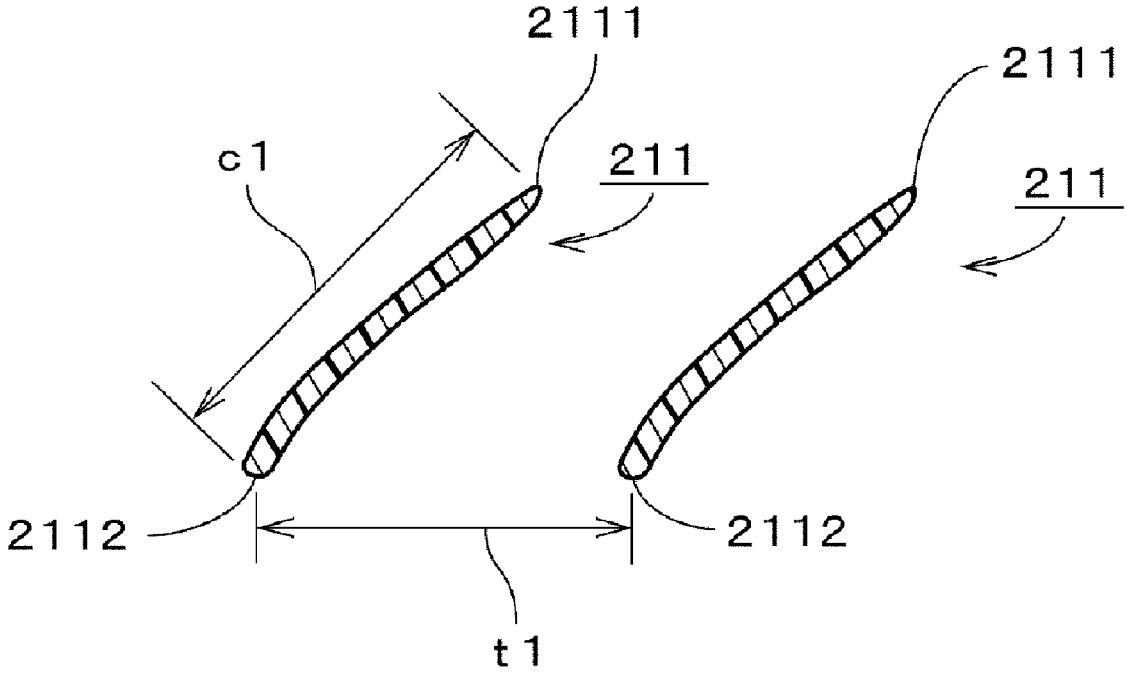
FIG. 7 illustrates sections of first blades according to a preferred embodiment of the present invention.
Figure 8:
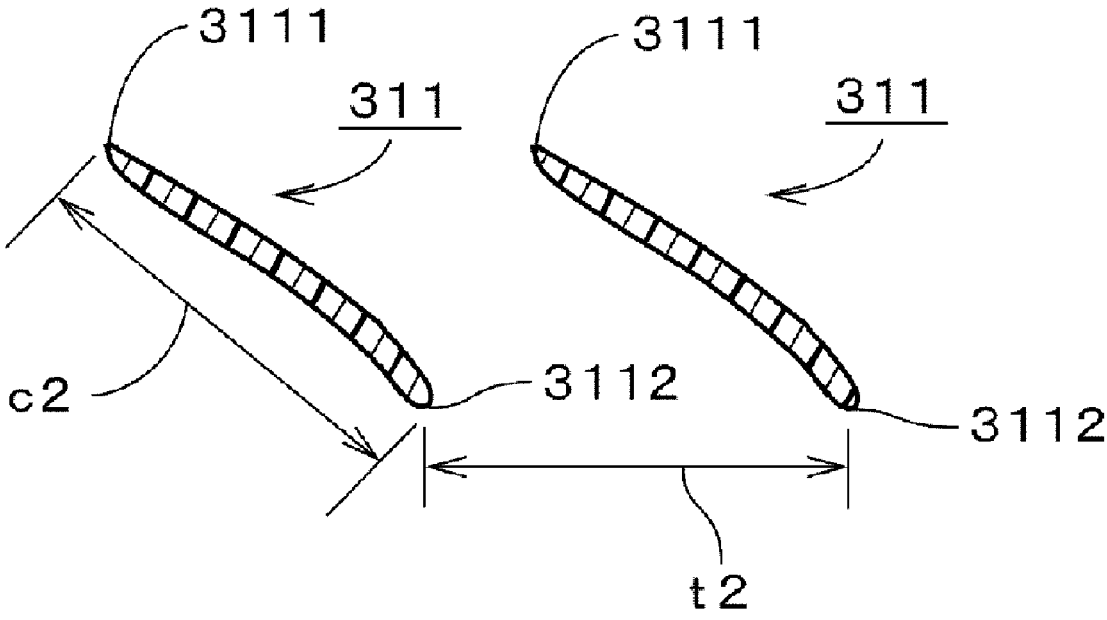
FIG. 8 illustrates sections of second blades according to a preferred embodiment of the present invention.

FIG. 7 illustrates two adjacent first blades 211. FIG. 8 illustrates two adjacent second blades 311. More specifically, FIGS. 7 and 8 illustrate sections of the two adjacent first blades 211 and the two adjacent second blades 311, respectively, taken on an imaginary cylindrical surface with a certain radius centered about the central axis J1, and developed on a plane.

In FIG. 7, the length of a chord joining the leading and trailing edges 2111 and 2112 of the first blade 211 is denoted by reference symbol c1, while a pitch between the two adjacent first blades 211 is denoted by reference symbol t1. In FIG. 8, similarly, the length of a chord joining the leading and trailing edges 3111 and 3112 of the second blade 311 is denoted by reference symbol c2, while a pitch between the two adjacent second blades 311 is denoted by reference symbol t2.

Hereinafter, the ratio (c1/t1) of the chord length c1 of the first blade 211 to the pitch t1 of the first blades 211 at a given radial position will be referred to as a "first solidity". In addition, the ratio (c2/t2) of the chord length c2 of the second blade 311 to the pitch t2 of the second blades 311 at the same radial position will be referred to as a "second solidity". In designing the first and second impellers 21 and 31, several radial positions are specified as reference positions. The shapes of the first and second blades 211 and 311 are determined such that the first solidity is greater than the second solidity at each of the reference positions.

As a result, in the serial axial fan 1, the first solidity is greater than the second solidity at almost every radial position. Hereinafter, the above-described relationship between the two impellers will be expressed as "the first solidity being greater than the second solidity". Note here that the first solidity may not necessarily be greater than the second solidity at every radial position. The first solidity may be less than the second solidity at some radial positions, such as a top of the blades or a base of the blades near the cup, for example. In other words, the first solidity need only be greater than the second solidity for most of the first and second blades 211 and 311.

Figure 9:
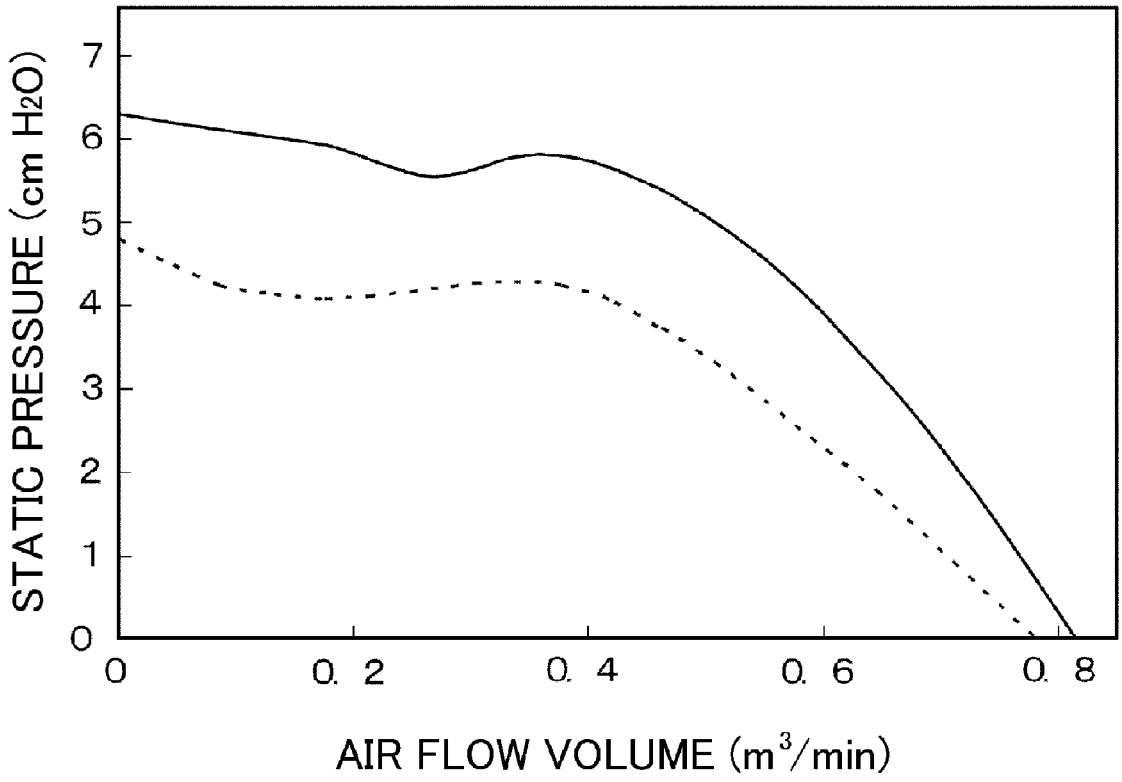
FIG. 9 illustrates a relationship between first and second solidities and the static pressure-air flow volume characteristic.

FIG. 9 illustrates a relationship between relative magnitude of the first and second solidities and the static pressure-air flow volume characteristic in serial axial fans. A horizontal axis represents the air flow volume ($m^3$/min), and a vertical axis represents the static pressure ($cmH_2O$).

The solid line in FIG. 9 indicates the static pressure-air flow volume characteristic of the serial axial fan 1, in which the first solidity is greater than the second solidity.

The broken line in FIG. 9 indicates the static pressure-air flow volume characteristic of a serial axial fan as comparative example 2. The serial axial fan as comparative example 2 is similar to the serial axial fan 1 except that the first solidity is equal to the second solidity, and that the angle defined by the chord of each of the first and second blades 211 and 311 with the rotational plane of the corresponding impeller decreases as the radial position of the chord moves outward.

As illustrated in FIG. 9, the serial axial fan 1 has an improved static pressure-air flow volume characteristic, compared to comparative example 2. Here, the noise level of the serial axial fan 1 is approximately 62 dB(A), while the noise level of comparative example 2 is approximately 64 dB(A). That is, the serial axial fan 1 produces less noise than comparative example 2.

Figure 10:
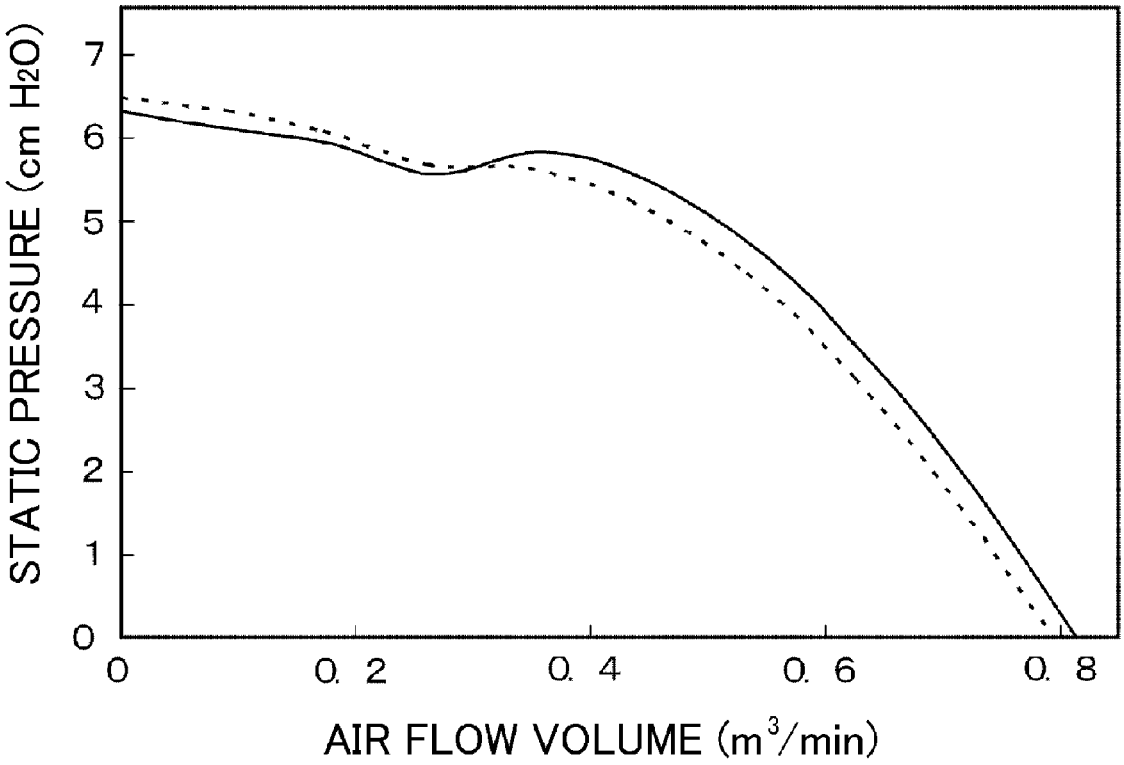
FIG. 10 illustrates a relationship between the number of second blades for a given number of first blades and the static pressure-air flow volume characteristic.

FIG. 10 illustrates a relationship between the number of second blades for a given number of first blades and the static pressure-air flow volume characteristic in serial axial fans.

The solid line in FIG. 10 indicates the static pressure-air flow volume characteristic of the serial axial fan 1. In the serial axial fan 1, the number of first blades 211 and the number of second blades 311 are both five.

The broken line in FIG. 10 indicates the static pressure-air flow volume characteristic of a serial axial fan as comparative example 3. The serial axial fan as comparative example 3 is similar to the serial axial fan 1 except that the number of second blades 311 is three.

As illustrated in FIG. 10, the serial axial fan 1, in which the first and second blades 211 and 311 are equal in number, achieves a slight improvement in the static pressure-air flow volume characteristic in a high air flow volume range, compared to comparative example 3. Here, the noise level of the serial axial fan 1 is approximately 62 dB(A), while the noise level of comparative example 3 is approximately 64 dB (A). In the case of the serial axial fan 1, a peak of interference noise generated between the two impellers is outside of the audible range. This allows the serial axial fan 1 to produce less noise than comparative example 3.

Figure 11:
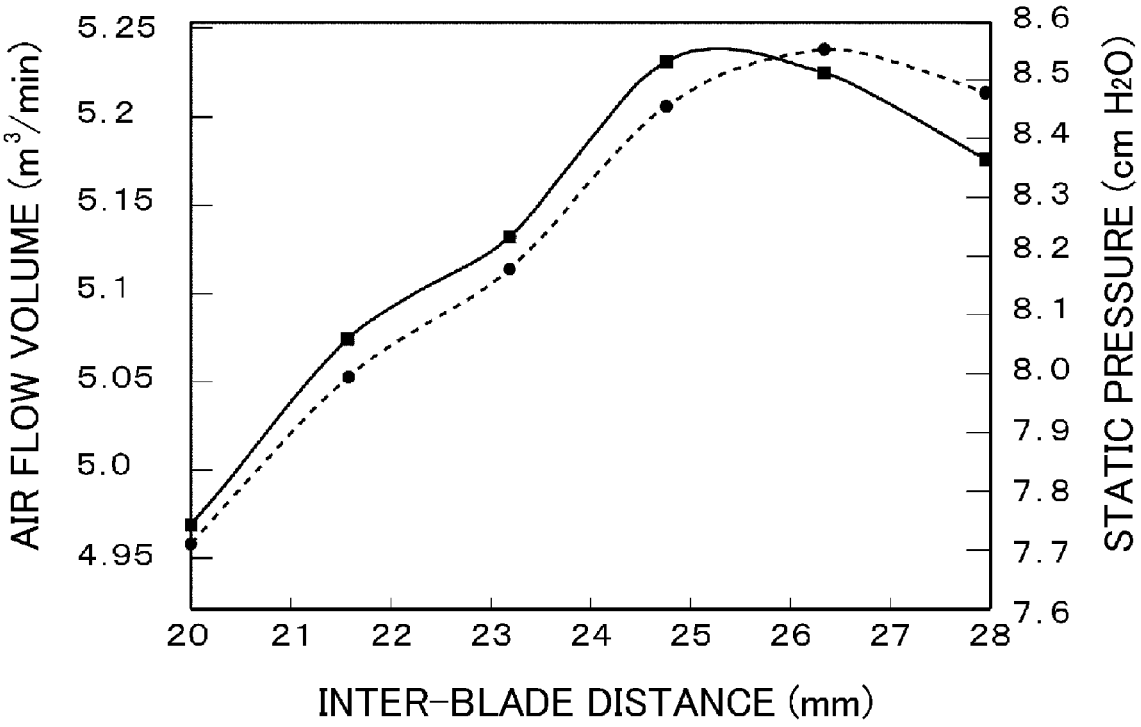
FIG. 11 illustrates relationships between an inter-blade distance and static pressure and between the inter-blade distance and air flow volume.

FIG. 11 illustrates relationships between an inter-blade distance of serial axial fans and the maximum air flow volume and maximum static pressure of the serial axial fans as measured while a rotation rate is adjusted so as to maintain a certain noise level. The term "inter-blade distance" as used herein refers to a distance, along the central axis J1, between a lower end of the first blades 211 and an upper end of the second blades 311. In FIG. 1, the inter-blade distance is denoted by reference symbol d.

Referring to FIG. 11, the solid line passing through the square dots (■) indicates how the air flow volume varies with inter-blade distance and the broken line passing through the circular dots (●) indicates how the static pressure varies with inter-blade distance. The serial axial fans exhibit the greatest air flow volume when the inter-blade distance is approximately 25 mm, and the greatest static pressure when the inter-blade distance is approximately 26 mm.

The results of the measurement as indicated in FIG. 11 are those of serial axial fans with an impeller diameter of approximately 43 mm. However, it is expected that measurement results similar to those indicated in FIG. 11 will be obtained for serial axial fans with an impeller diameter of approximately 25 mm to approximately 200 mm inclusive, which is a common range of the impeller diameter for serial axial fans designed to cool an electronic device. Therefore, in order to allow the serial axial fan 1 as illustrated in FIG. 1 to achieve noise reduction, the diameter of the first and second impellers 21 and 31 is preferably in the range of approximately 25 mm to approximately 200 mm inclusive, more preferably in the range of approximately 30 mm to approximately 100 mm inclusive, and the inter-blade distance d is preferably in the range of approximately 23 mm to approximately 30 mm inclusive, more preferably in the range of approximately 25 mm to approximately 28 mm inclusive.

As described above, in the serial axial fan 1, the static pressure-air flow volume characteristic can be improved while reducing an increase in noise since the first solidity is greater than the second solidity and the number of first blades 211 is equal to the number of second blades 311. It is preferable that the diameter of the first and second impellers 21 and 31 be in the range of approximately 25 mm to approximately 200 mm inclusive, and that the inter-blade distance d be in the range of approximately 23 mm to approximately 30 mm inclusive, in order to further reduce the increase in noise.

Moreover, the fact that the angle defined by the chord of each of the first and second blades 211 and 311 with the rotational plane of the corresponding impeller increases as the radial position of the chord moves outward contributes to improving air blowing efficiency of the serial axial fan 1. Since the first and second housings 23 and 33 of the serial axial fan 1 are separate members, it is possible to construct each axial fan independently with ease.

Figure 12:
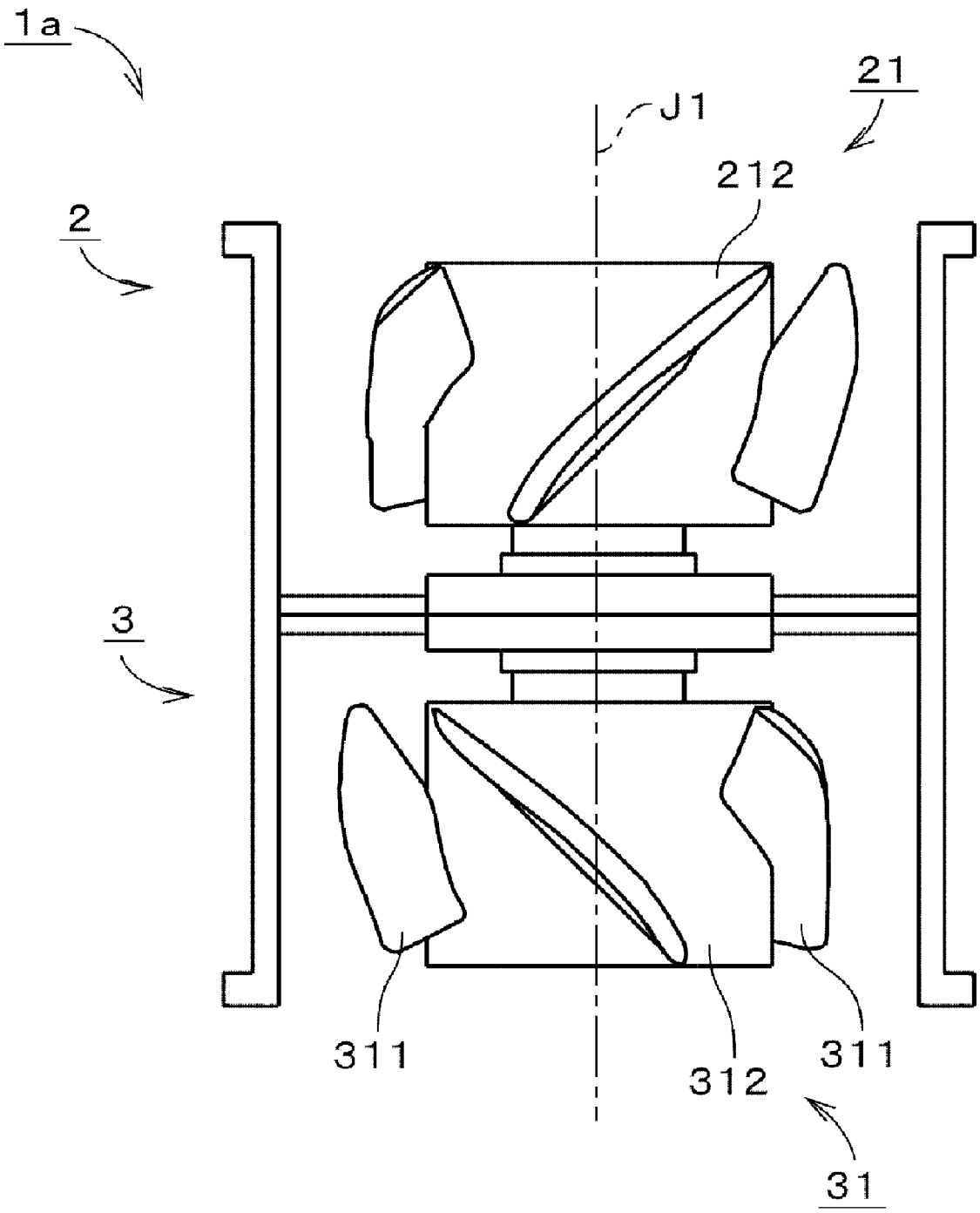
FIG. 12 illustrates a serial axial fan according to another preferred embodiment of the present invention.

FIG. 12 illustrates a serial axial fan 1*a* according to another preferred embodiment of the present invention. In the serial axial fan 1*a*, the height, i.e., the dimension along the central axis J1, of the second impeller 31 is equal to the height of the first impeller 21. The serial axial fan 1*a* is similar to the serial axial fan 1 as illustrated in FIG. 1 in the other structural aspects. Therefore, the cup 312 of the second impeller 31 of the second axial fan 3 is similar to the cup 212 of the first impeller 21 except that the cup 312 is arranged in an upside-down orientation as compared with the cup 212.

As with the first blade 211 as illustrated in FIG. 5, the angle defined by the chord of each second blade 311 with the rotational plane of the corresponding impeller increases as the radial position of the chord moves outward. In addition, the dimension of each second blade 311 in the direction parallel or substantially parallel to the central axis J1, across its width between the leading and trailing edges, increases in the radially outward direction. Further, as is the case with the first blades 211 as illustrated in FIGS. 2 and 3, the circumferential width of each second blade 311 between the leading and trailing edges also increases in the radially outward direction. The thickness of each second blade 311 is also arranged to be greater at the radially inner portion thereof than at the radially outer portion thereof.

In the serial axial fan 1*a*, the whirl component of air produced by the first axial fan 2 can be converted in the second axial fan 3 into an airflow traveling in the axial direction. This contributes to improving the static pressure-air flow volume characteristic while increasing a workload on the radially outer portion of the blades for a given power consumption.

While preferred embodiments of the present invention have been described above, it should be appreciated that the present invention is not limited to the above-described preferred embodiments, and that various variations are possible.

For example, as long as a sufficient static pressure-air flow volume characteristic is obtained, the angle defined by the chord of each second blade 311 of the second impeller 31 with the rotational plane of the impeller may decrease as the radial position of the chord moves outward in other preferred embodiments of the present invention.

The first and second base portions 24 and 34 of the serial axial fan 1 or la may not necessarily be in contact with each other. The first and second base portions 24 and 34 may be merely arranged in proximity to each other in other preferred embodiments of the present invention. Further, the first and second axial fans 2 and 3 may not necessarily be oriented in opposite directions so that they are arranged back to back with each other. For example, the second support ribs 35 of the second axial fan 3 may be arranged on an outlet side, or the first support ribs 25 of the first axial fan 2 may be arranged on an inlet side in other preferred embodiments of the present invention.

The first and second base portions 24 and 34 may not necessarily be arranged opposite to each other. For example, the first base portion 24 and the first support ribs 25 of the first axial fan 2 may be arranged on the inlet side, or the second base portion 34 and the second support ribs 35 of the second axial fan 3 may be arranged on the outlet side in other preferred embodiments of the present invention.

The number of first blades 211 and the number of second blades 311 are not limited to five. For example, the number of first blades 211 and the number of second blades 311 may be seven in other preferred embodiments of the present invention. The number of fans provided in the serial axial fan 1 or 1*a* may be greater than two. For example, an additional axial fan may be provided on the outlet side of the second axial fan 3 or on the inlet side of the first axial fan 2, or both on the outlet side of the second axial fan 3 and on the inlet side of the first axial fan 2 in other preferred embodiments of the present invention.

Preferred embodiments of the present invention are usable as cooling fans to cool electronic devices or the like, and also as other types of fans than the cooling fans.

While preferred embodiments of the present invention have been described above, it is to be understood by those skilled in the art that variations and modifications can be made without departing from the scope and spirit of the present invention. The scope of the present invention is therefore to be determined solely by the following claims.

What is claimed is:

1. A serial axial fan comprising:

a first axial fan; and a second axial fan connected to the first axial fan along a central axis of the first axial fan; wherein the first axial fan includes:

a first motor portion;

a first impeller having a plurality of first blades extending radially outward, centered about the central axis and arranged at regular intervals in a circumferential direction and to rotate about the central axis in response to action of the first motor portion to produce an air flow along the central axis and toward the second axial fan; and a first housing surrounding an outer circumference of the first impeller;

the second axial fan includes:

a second motor portion;

a second impeller having a plurality of second blades extending radially outward, centered about the central axis and arranged at regular intervals in the circumferential direction and to rotate about the central axis in response to action of the second motor portion in an opposite direction to that in which the first impeller rotates, to produce an air flow in the same direction as that of the air flow produced by the first impeller; and a second housing surrounding an outer circumference of the second impeller;

in the first impeller, an angle defined by a rotational plane, perpendicular or substantially perpendicular to the central axis, of the first impeller with a chord of each first blade on an imaginary cylindrical surface centered about the central axis increases as a radius of the imaginary cylindrical surface increases;

a first solidity, which is defined as a ratio of a chord length of the first blades of the first impeller to a pitch of the first blades, is greater than a second solidity, which is defined as a ratio of a chord length of the second blades of the second impeller to a pitch of the second blades, when the first solidity and the second solidity correspond to an additional imaginary cylindrical surface taken at an outer radial position of each of the first blades and the second blades; and the first solidity is greater than the second solidity along most of the radius of the imaginary cylindrical surface.

2. The serial axial fan according to claim 1, wherein a dimension of each first blade in a direction parallel or substantially parallel to the central axis, across a width of the first blade between leading and trailing edges thereof, increases in a radially outward direction.

3. The serial axial fan according to claim 2, wherein a dimension of each first blade in the circumferential direction between the leading and trailing edges thereof increases in the radially outward direction.

4. The serial axial fan according to claim 1, wherein in the second impeller, an angle defined by a rotational plane, perpendicular or substantially perpendicular to the central axis, of the second impeller with a chord of each second blade on the imaginary cylindrical surface centered about the central axis increases as the radius of the imaginary cylindrical surface increases.

5. The serial axial fan according to claim 4, wherein a dimension of each second blade in a direction parallel or substantially parallel to the central axis, across a width of the second blade between leading and trailing edges thereof, increases in a radially outward direction.

6. The serial axial fan according to claim 5, wherein a dimension of each second blade in the circumferential direction between the leading and trailing edges thereof increases in the radially outward direction.

7. The serial axial fan according to claim 1, wherein the number of first blades is equal to the number of second blades.

8. The serial axial fan according to claim 1, wherein an axial length of the first blades along the central axis is greater than an axial length of the second blades.

9. The serial axial fan according to claim 1, wherein diameters of the first and second impellers are in a range of about 25 mm to about 200 mm inclusive, and a distance between the first blades and the second blades along the central axis is in a range of about 23 mm to about 30 mm inclusive.

10. The serial axial fan according to claim 1, wherein the first axial fan further includes a first base portion adjacent to the second axial fan to support the first motor portion, and a plurality of first support ribs arranged to join the first base portion to the first housing; and the second axial fan further includes a second base portion in contact with or in proximity to the first base portion to support the second motor portion, and a plurality of second support ribs arranged to join the second base portion to the second housing.

11. The serial axial fan according to claim 1, wherein the first and second housings are defined by separate members.

* * * * *